US006484697B2

(12) United States Patent
Boecking

(10) Patent No.: US 6,484,697 B2
(45) Date of Patent: Nov. 26, 2002

(54) PRESSURE-CONTROLLED CONTROL PART FOR COMMON-RAIL INJECTORS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/893,416

(22) Filed: Jun. 29, 2001

(65) Prior Publication Data

US 2002/0020394 A1 Feb. 21, 2002

(30) Foreign Application Priority Data

Jun. 29, 2000 (DE) ..... 100 31 580

(51) Int. Cl.[7] ..... F02M 37/04
(52) U.S. Cl. ..... 123/467; 239/96
(58) Field of Search ..... 123/467, 456, 123/514; 239/88–96

(56) References Cited

U.S. PATENT DOCUMENTS 5,476,245 A * 12/1995 Augustin ..... 251/129.02
5,671,715 A * 9/1997 Tsuzuki ..... 123/467
5,893,350 A * 4/1999 Timms ..... 123/467
5,941,215 A * 8/1999 Augustin ..... 123/467
5,984,200 A * 11/1999 Augustin ..... 239/88
6,029,632 A * 2/2000 Augustin ..... 123/506
6,244,245 B1 * 6/2001 Boecking ..... 123/467
2002/0020759 A1 * 2/2002 Boecking ..... 239/96
2002/0023970 A1 * 2/2002 Boecking ..... 239/96

* cited by examiner

*Primary Examiner*—Thomas N. Moulis
(74) *Attorney, Agent, or Firm*—Ronald E. Greigg

(57) ABSTRACT

The invention relates to an injector for injecting fuel that is at very high pressure, which is present at the injector in a common-rail inlet. The fuel acts on a control part, which is actuatable via a fuel volume contained in the control chamber. An inlet and an outlet of the control chamber are each provided with spring elements; the control chamber can be pressure-relieved via a valve element actuatable by means of an actuator. The control part in the injector housing is guided in two guide portions.

11 Claims, 1 Drawing Sheet

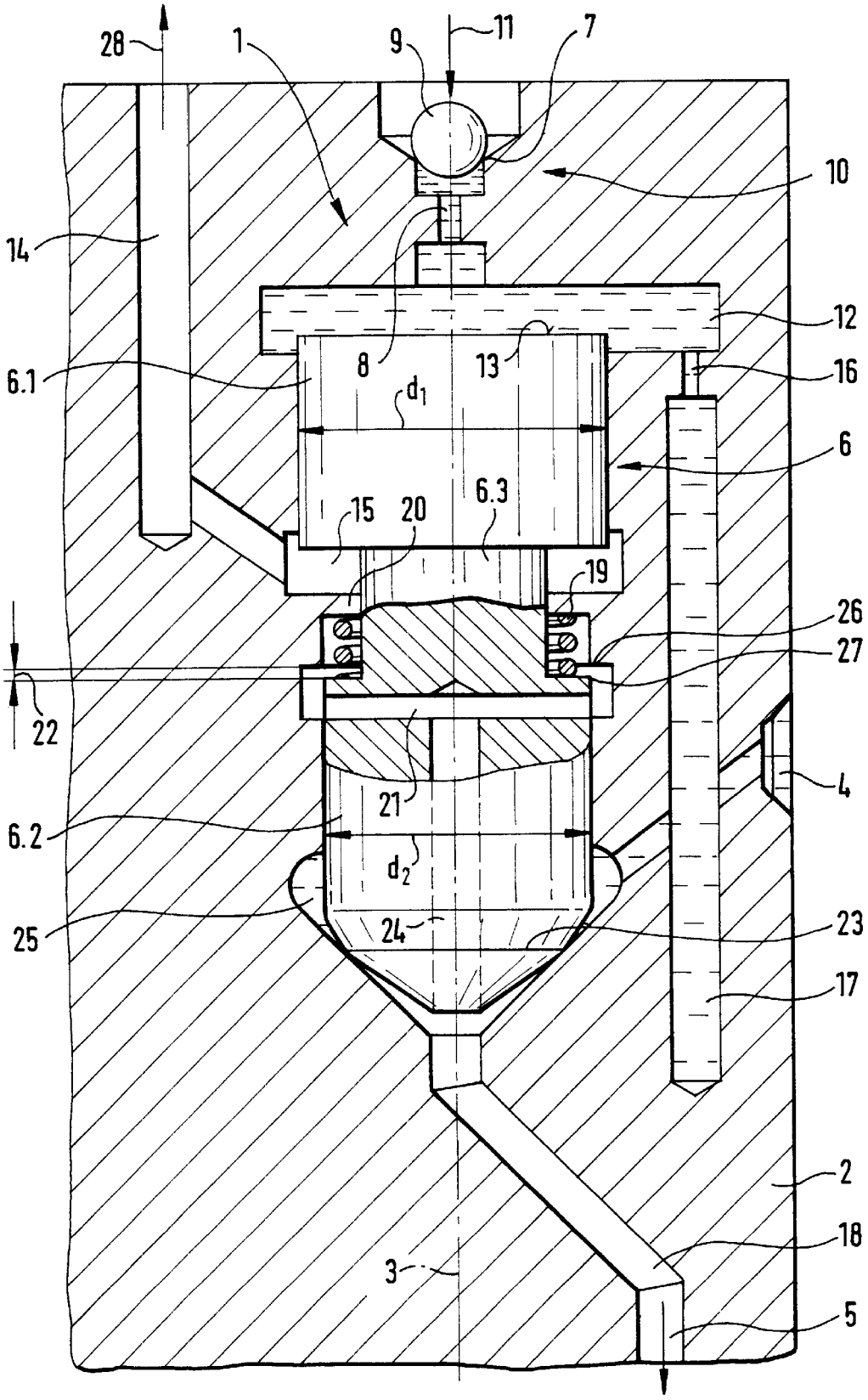
28
1
9
11
7
10
14
12
6.1
8
13
16
$d_1$
6
15
20
6.3
19
26
27
22
4
21
6.2
$d_2$
25
24
23
17
2
18
3
5

PRESSURE-CONTROLLED CONTROL PART FOR COMMON-RAIL INJECTORS

BACKGROUND OF THE INVENTION

1. Field of the Invention

The efficiency of control parts that are used in high-pressure collection chamber (common rail) injection systems depends sharply and the fuel volume that because of the extremely high pressure prevailing in the common rail flows into an outflow-side fuel outlet when the supply line from the common rail is opened. The smaller this fuel volume and the fuel volume required to control the control part are, the greater is the efficiency that can be attained with a fuel injector. Besides high efficiency of an injector for direct-injection internal combustion engines, a compact design of such a structural component is of great importance.

2. Description of the Prior Art

German patent disclosure DE 198 35 494 A1 relates to a unit fuel injector used to deliver fuel to a combustion chamber of direct-injection internal combustion engines with a pump unit that serves to build up an injection pressure and to inject the fuel into the combustion chamber via an injection nozzle. The unit fuel injector has a control unit with a control valve, which is embodied as an outward-opening A-valve, and a valve actuation unit for controlling the pressure buildup in the pump unit. To create a unit fuel injector with a control unit that is simple in design and small in size, and in particular has a short response time, in the version of DE 198 35 494 A1 the valve actuation unit is embodied as a piezoelectric actuator.

In this version, a guide ring is supported axially displaceably in the interior of the transmission body. Also in the interior of the guide ring, a valve shaft is prestressed against the valve body by means of a U-shaped disk and a cup spring. The guide ring rests on the valve body by means of a flat seat. The flat seat can also be embodied by other forms of seat. The spring element acts on the guide ring and is braced on the transmission body. The spring element is embodied as a compression spring. The valve actuation unit and the control valve are disposed such that their respective longitudinal axes extend congruently. The control part assembly known from DE 198 35 494 A1 requires close tolerances, which are complicated to produce for technical production reasons, in order to adapt the diameters, in particular, to one another with extreme precision. The high demands in terms of tolerances made of the components dictate correspondingly expensive production with high engineering effort and stringent demands in terms of the precision measurements of the components in question.

SUMMARY OF THE INVENTION

The advantages attainable with the version according to the present invention are seen above all in the fact that the control part of the control valve is guided in two guides, which are located in separate bodies. As a result, from a production standpoint the guides can be produced with the required tolerances substantially more simply and hence more economically. The design of the injector in the proposed version can also be made simpler, since in comparison to versions known from the prior art, fewer moving parts are needed.

Embodying two diameter regions on the control part also makes a control part possible that closes cleanly; that is, the control part moves cleanly into its seat face that closes the nozzle inlet in the injector housing. The retraction motion is reinforced by a spring element, supported on the control part in a way that is secured against kinking, that is braced on a collar located in the interior of the injector housing.

By means of the two guide portions embodied by different diameter regions on the control part, more secure and very fast closing of the hollow chamber located on the leaking oil outlet side in the injector housing is achieved, and thus a loss of fuel volume can be avoided. This in turn considerably enhances the efficiency of the control part of the injector, received in independent guides, as proposed by the invention.

Since a control edge that seals off the hollow chamber between the two guide portions is embodied on the control part, one leaking oil connection suffices on the control part designed according to the invention, which is movable in two guides separate from one another. This allows more-economical production of the injector housing of the pressure-controlled, two-piece injector for common-rail use. Since it has been possible to reduce the number of moving parts considerably, an increase in the service life of the pressure-controlled injector is also attainable.

BRIEF DESCRIPTION OF THE DRAWING

The injector assembly according to the invention will be described in detail below in conjunction with the drawing in which: the sole drawing FIGURE shows a pressure-controlled injector for direct-injection internal combustion engines, whose control part has two separate guide portions and on whose second guide portion a control edge that cooperates with the injector housing is embodied.

DESCRIPTION OF THE PREFERRED EMBODIMENTS

In the injector housing 2 of the injector 1, a control part 6 is received that is rotationally symmetrical to an axis of symmetry 3. A common-rail inlet 4 branching off from a high-pressure collection chamber (common rail), not shown here, discharges into the injector housing 2. A fuel supply that is at very high pressure is received in the common rail, and the pressure in the common rail is also present, via the common-rail inlet 4, at a nozzle chamber 25 embodied in the injector housing 2. Branching off from the nozzle chamber 25 is a nozzle inlet 5, which is designed as a conduit 18 in the injector housing 2 and supplies an injection nozzle, not further shown here, with an injection quantity that is to be injected into the combustion chamber of a direct-injection internal combustion engine.

In the upper region of the injector 1, a control part 9 is provided, as shown in FIG. 1. The control part 9 can, as shown in FIG. 1, be embodied as a ball element, which can be actuated via a valve actuation unit not shown in detail here, that takes the form of an electromagnet or a piezoelectric actuator. With the control part 9, which is urged in the effective direction 11 by the actuator, a seat diameter 7 is closed, into which an outlet throttle 8 provided on the outlet side discharges. The outlet throttle 8 branches off from a control chamber 12 provided in the injector housing 2, and fuel at high pressure continuously flows in to replenish the control chamber via an inlet throttle 15, so that the high pressure prevailing in the common-rail inlet 4 is always present in the control chamber 12.

By means of the control volume received in the control chamber 12, the control part 6 embodied rotationally symmetrical to the axis of symmetry 3 can be moved up and down. An end face 13 of the control part 6, that is, of a guide portion 1 6.1, protrudes into the control chamber 12, in the position of the control part 6 shown in FIG. 1. The first guide portion 6.1 of the control part is embodied with a first diameter $d_1$ and is guided in a first bore portion in the injector housing 1. The first guide portion 6.1 changes into a tapered region 6.3 of the control part 6, which is adjoined by a second guide portion 6.2, embodied with a second, lesser diameter $d_2$ than the diameter $d_1$ of the first guide element 6.1. The second guide portion 6.2, guided in a bore in the injector housing 2 that is embodied with the lesser diameter $d_2$, is penetrated on the one hand by a transverse bore 21 and on the other has a coaxial bore 24, which discharges into the nozzle chamber 25 in the injector housing 2. A seat 23 is furthermore embodied on the second guide portion of the control part 6, and the conically tapering lower region of the second guide portion 6.2 of the control part 6 is pressed into this seat, as long as the diameter 12 is not pressure-relieved by the actuation of the piezoelectric actuator or electromagnet that acts on the control part 6.

The injector housing 2 also includes a hollow chamber 15 on the leaking oil side, which is defined by the two guide portions 6.1 and 6.2 and from which a leaking oil line 14 branches off, discharging into a pressureless fuel tank not shown here but indicated by an arrow 28. In the hollow chamber 15, defined by the respective end faces of the first and second guide portion 6.1 and 6.2, an annularly extending stop face 20 is formed on which one end of the spring element 19 is braced. The opposite end of the spring element is braced on an upper end face of the second guide portion 6.2 of the control part, which is embodied with the second diameter $d_2$. A control edge 27 is embodied on the circumferential surface of the second guide portion 6.2 and cooperates with a corresponding control edge, here identified by reference numeral 26, of the injector housing 2.

Upon triggering of the piezoelectric actuator or electromagnet acting on the control valve 9, this valve is pressure-relieved, and it moves out of its seat diameter 7, since the force acting on it, represented by the arrow 11, is no longer exerted. As a result, some of the control volume received in the control chamber 12 flows out via the outlet throttle 8 on the leaking oil side, causing the control valve 6 to move vertically upward. The end face 13 embodied on the first guide portion 6.1 of the control part 6 therefore moves, compressing the spring element 19, partway into the control chamber 12 and positively displaces the control volume through the outlet throttle 8. As a result, the conical region of the second guide portion 6.2, embodied with the diameter $d_2$, moves out of its seat diameter 23 and uncovers the nozzle inlet 5, which extends toward the injection nozzle, not shown here.

At the instant when a pressure relief of the control chamber takes place by actuation of the control valve 9 and a vertical motion upward of the control part 6 ensues, the control edge 27 embodied on the outer circumferential surface of the second guide portion 6.2 covers the corresponding control edge 26 on the injector housing 2 and thus seals the hollow chamber 15, between the first guide portion 6.1 and the second guide portion 6.2 of the control part 6 from the leaking oil outlet 14, counter to the fuel at high pressure that is flowing in from the common-rail supply line 5. The stroke length 22, which is adjustable via the fuel volume escaping from the control chamber 12, is dimensioned such that when the seat 23 is opened by the upward-moving control part 6, the control edge 26 of the injector housing 2 is effectively covered. The vertical upward motion of the control part 6 that ensues in the stroke direction via the stroke height 22 is reinforced by the diameter ratios. The diameter $d_1$ of the first guide portion 6.1 is dimensioned as considerably larger than the diameter $d_2$ of the second guide portion of the control part 6. The upward motion of the control part 6 into the control chamber 12 upon the escape of the control volume via the outlet throttle 8 is effectively reinforced by the high pressure present in the hollow chamber 15 via the axial bore 24, the transverse bore 21 and the opening between the portion 6.3 and the circumferential surface of the collar 20, so that the two control edges 27 and 26 can overlap quickly. As a result, only one leaking oil connection 14 needs to be provided in the injector housing 2 of the injector 1 of FIG. 1, since this connection is located in the transitional region between the first guide portion 6.1 and the second guide portion 6.2

The control part 6 embodied rotationally symmetrical relative to its axis of symmetry 3 is accordingly guided in two mutually independent guide portions 6.1 and 6.2 in corresponding bore portions in the injector housing 2. Because they are decoupled from one another, the bore portions in the injector housing 2 and the guide portions 6.1 and 6.2, each embodied in different diameter classes $d_1$ and $d_2$, can be produced substantially less expensively, resulting overall in a simpler design of an injector suitable for and usable in common-rail applications. With the version proposed by the invention, it is above all possible to reduce the number of moving parts significantly in comparison to the versions known from the prior art, so that the service life of such an injector for common-rail applications can thus also be lengthened considerably. In a comparable way, the portion 6.3 located between the first guide portion 6.1 and the second guide portion 6.2 can be used as a guide for the compression spring 19, to counteract the tendency of this spring to kinking.

In the injector housing 2, the leaking oil line 14 and the conduit 18, which discharges into the supply line 5 of the injection nozzle, not shown here, can be drilled in the form of conduits or created in some other way. A bore 17 extending parallel to the axis of rotation also extends through the injector housing and discharges into an inlet throttle 16. Via the inlet throttle 16, which communicates with the control chamber 12 in the injector housing 2 and receives the control volume, the high fuel pressure prevailing in the common-rail supply line 4, is always present in the control chamber 12, so that a direct response of the control part 6 to a pressure relief of the control chamber 12 is provided for by the opening of the control valve 9.

With the configuration shown, a 3/2-way valve can be designed and operated as a 2/2-way valve, and the high pressure prevailing in the common rail, which also prevails in the nozzle chamber 25 in the injector housing 2 via the common-rail supply line 4, always prevails at this control valve.

The foregoing relates to preferred exemplary of embodiments of the invention, it being understood that other variants and embodiments thereof are possible within the spirit and scope of the invention, the latter being defined by the appended claims.

I claim:

1. In an injector for injecting fuel that is at high pressure and is present at the injector in a common rail inlet (4) and acts on a control part (6) which is actuatable via a fuel volume contained in a control chamber (12), in which an inlet (16) and an outlet (8) of the control chamber (12) are provided with throttle elements, and the control chamber (12) can be pressure-relieved via a valve element (9) actuatable by means of an actuator, the improvement wherein said control part (6) is guided in the injector housing (2) by two guide portions (6.1, 6.2).

2. The injector for injecting fuel that is a high pressure according to claim 1, further comprising a hollow chamber (15) on a leaking oil side of said two guide portions, said hollow chamber being defined by a first guide portion and a second guide portion (6.1, 6.2).

3. The injector according to claim 1, wherein said first guide portion (6.1) is embodied with a first diameter $d_1$ and the second guide portion (6.2) is embodied with a second diameter $d_2$.

4. The injector according to claim 3, wherein said diameter $d_1$ of said first guide portion (6.1) exceeds the diameter of said second guide portion (6.2).

5. The injector according to claim 1, further comprising a spring element (19) received in said housing (2) said spring element (19) acting on one face end of said second guide portion (6.2) and reinforcing the closing motion of said control part (6) into its seat (23).

6. The injector according to claim 5, wherein said spring element (19) is braced on a stop face (20) of said housing (2).

7. The injector according to claim 1 further comprising a control edge (27) embodied on said second guide portion (6.2), which edge cooperates with an edge (26) of the injector housing (2) to reduce leakage from the common rail inlet (4) when the control part (6) moves a sufficient distance in its opening direction.

8. The injector according to claim 5, further comprising a transition portion (6.3) on said control part (6) between said two guide portions (6.1 and 6.2), said spring element (19) being received on said transition portion (6.3).

9. The injector according to claim 1 wherein, upon pressure relief of said control chamber (12), the stroke length (22) of said control part (6) closes a hollow chamber (15) which is positioned on the leaking oil side of guide portions (6.1, 6.2) relative to control chamber (12) and a nozzle inlet (5) respectively.

10. The injector according to claim 2 further comprising a control edge (27) embodied on said second guide portion (6.2), which edge cooperates with an edge (26) of the injector housing (2) to reduce leakage from the common rail inlet (4) when the control part (6) moves a sufficient distance in its opening direction.

11. The injector according to claim 2 wherein, upon pressure relief of said control chamber (12), the stroke length (22) of said control part (6) closes the hollow chamber (15) on the leaking oil side of guide portion 6.2 relative to a nozzle inlet (5).

* * * * *